US005458288A

United States Patent [19]

Mullick et al.

[11] Patent Number: 5,458,288

[45] Date of Patent: Oct. 17, 1995

[54] DRINKING FOUNTAIN

[75] Inventors: Abir Mullick, Buffalo; Michael Osadciw, Rochester; Michael F. LaMonica, Brentwood; Matthew C. Guthrie, Penfield, all of N.Y.

[73] Assignee: The Research Foundation of State University of New York, Albany, N.Y.

[21] Appl. No.: 218,141

[22] Filed: Mar. 26, 1994

[51] Int. Cl.[6] ..... E03B 9/20

[52] U.S. Cl. ..... 239/29; 4/675; D7/304; 251/238

[58] Field of Search ..... 239/24, 28–32; 4/675, 678; D7/304; 137/624.11; 251/238, 243, 263

[56] References Cited

U.S. PATENT DOCUMENTS

| | | | |
|---|---|---|---|
| D. 239,284 | 3/1976 | Haws et al. | D7/304 |
| D. 252,207 | 6/1979 | Haws et al. | D7/304 |
| D. 261,518 | 10/1981 | Butter et al. | D7/304 |
| 4,295,609 | 10/1981 | Brown, Jr. | 239/29 |
| 4,520,960 | 6/1985 | Cushman et al. | 239/29 |
| 4,597,525 | 7/1986 | Cushman et al. | 239/28 |
| 4,783,002 | 11/1988 | Raymer et al. | 239/29 |

OTHER PUBLICATIONS

1986 Sweets Catalog File, Section 15.7c/Eb, Ebco Mfg. Co. ©1985, pp. 4–5.

*Primary Examiner*—Karen B. Merritt

*Attorney, Agent, or Firm*—Ronald Coslick

[57] ABSTRACT

The invention involves the use in a drinking fountain of a large control bar which is pressed by the user to operate a water flow control mechanism. The control bar is located at the front of the fountain. The control bar covers the entirety of the front of the fountain, providing the user clear access to the control bar without obstruction by any other part of the fountain when the fountain is approached at its front. The control bar operates a valve which controls water flow. The embodiment of the control bar and associated mechanisms for controlling the valve may be entirely mechanical, entirely electrical, or a combination of the two. The control bar may additionally be provided with a surface which is sensuously differentiable from the rest of the fountain. An additional feature may be a pair of handles, located to the rear of the basin and along opposite sides of the fountain, which allows a user to pull his body toward the fountain so that his chest presses against the control bar as he leans in toward the basin. Each and all of these features may be embodied in either a wall mounted or a free standing drinking fountain.

11 Claims, 9 Drawing Sheets

DRINKING FOUNTAIN

BACKGROUND OF THE INVENTION

The invention relates to drinking fountains. More particularly, this invention relates to universal access drinking fountains which are designed for comfortable use by the entire public including those with disabilities.

The prior art contains several utility patents which disclose wall-mounted drinking fountains which are intended to provide universal access:

Brown, U.S. Pat. No. 4,295,609, filed Nov. 6, 1978 and issued Oct. 20, 1981, is a drinking fountain unit which is mounted on and extends from a wall. The unit is mounted at a height so as to allow clearance for a person in a wheel chair to maneuver the chair into the space beneath the unit and lean into the unit to take a drink. A spring-biased horizontal bar located on the front of the fountain opens a standard valve to control water flow.

Cushman et al., U.S. Pat. No. 4,520,960, filed Jan. 13, 1983 and issued Jun. 4, 1985, and its divisional, U.S. Pat. No. 4,597,525, filed Mar. 18, 1985 and issued Jul. 1, 1986, also disclose wall-mounted drinking fountains which are mounted to provide clearance for wheel chair access and which use horizontal bars to control water flow.

In addition to the above-mentioned utility patents, the prior art contains several design patents which disclose free standing universal access drinking fountain designs:

Butter et al., U.S. Pat. No. Des. 261,518, filed Apr. 30, 1979 and issued Oct. 27, 1981, shows a free standing fountain which has semicircular underside and round buttons located at either side of the basin which are pushed inward toward the basin to control water flow.

Haws et al., U.S. Pat. No. Des. 252,207, filed Oct. 6, 1976 and issued Jun. 26, 1979, shows a free standing fountain having a cantilevered basin and a side mounted twist handle for controlling water flow.

Haws et al., U.S. Pat. No. Des. 239,284, filed Aug. 5, 1974 and issued Mar. 23, 1976, also shows a free standing fountain having a cantilevered basin and a side mounted twist handle for controlling water flow.

While each of the recited prior art devices provides clearance for wheelchair access, there are other factors in addition to clearance which must be considered in designing drinking fountains for use by persons who are in wheel chairs or who are otherwise disabled.

One factor is the type of control means which is provided to the user to control water flow. Some control means require an awkward motion, such as twisting a small knob or depressing a small button from a height above that of a user sitting in a wheel chair. Some are too small or oddly shaped for some users to successfully operate, and some are hard for some users to locate. Some require the application of a force which may be beyond the capability of a disabled user. Some require the application of a continuous and steady force which some users will be incapable of generating. All assume that the user will be operating the fountain by hand.

A related factor is the location of the control means in relation to the rest of the drinking fountain. Some prior art control means are recessed so as to be nearly flush with the body of the fountain. These may be hard for a disabled user to discern or operate.

Another factor affecting use by the disabled is the location of the control means in relation to the natural position of the user. Often the location of the control means prevents comfortable use of the fountain from the posture to which the disabled user is restricted. For example, to drink from some prior art wall-mounted fountains, a user in a wheel chair must lean in toward the basin yet keep one arm arched back to operate the control means. In these cases such a user may be forced to resort to approaching the drinking fountain from the side, thereby placing his face directly in the path of an oncoming water stream. In others control means project from the fountain in a direction which is adapted for use from a standing position.

Another factor is the shape of water stream outlet. Outlets in prior art drinking fountains are small and angular, and may project several inches outward from the body of the fountain. These pose a risk of injury to an unsteady user.

SUMMARY OF THE INVENTION

The invention disclosed herein involves the use in various combinations of several novel features which solve the inherent problems of prior art universal access drinking fountains. One feature is the use of a large control bar which is pressed by the user to operate a water flow control mechanism. The control bar is located at the front of the fountain. The control bar covers the entirety of the front of the fountain, providing the user clear access to the control bar without obstruction by any other part of the fountain when the fountain is approached at its front. The control bar operates a valve which controls water flow. The embodiment of the control bar and associated mechanisms for controlling the valve may be entirely mechanical, entirely electrical, or a combination of the two.

The control bar may additionally be provided with a surface which is sensuously differentiable from the rest of the fountain, thereby allowing the user to easily discern where water flow is to be controlled. Differentiability may be tactile, visual, or both.

An additional feature may be a pair of handles, located to the rear of the basin and along opposite sides of the fountain, which allows a user to pull his body toward the fountain so that his chest presses against the control bar as he leans in toward the basin.

Each and all of these features may be embodied in either a wall mounted or a free standing drinking fountain.

DETAILED DESCRIPTION OF THE INVENTION

Figure 1:
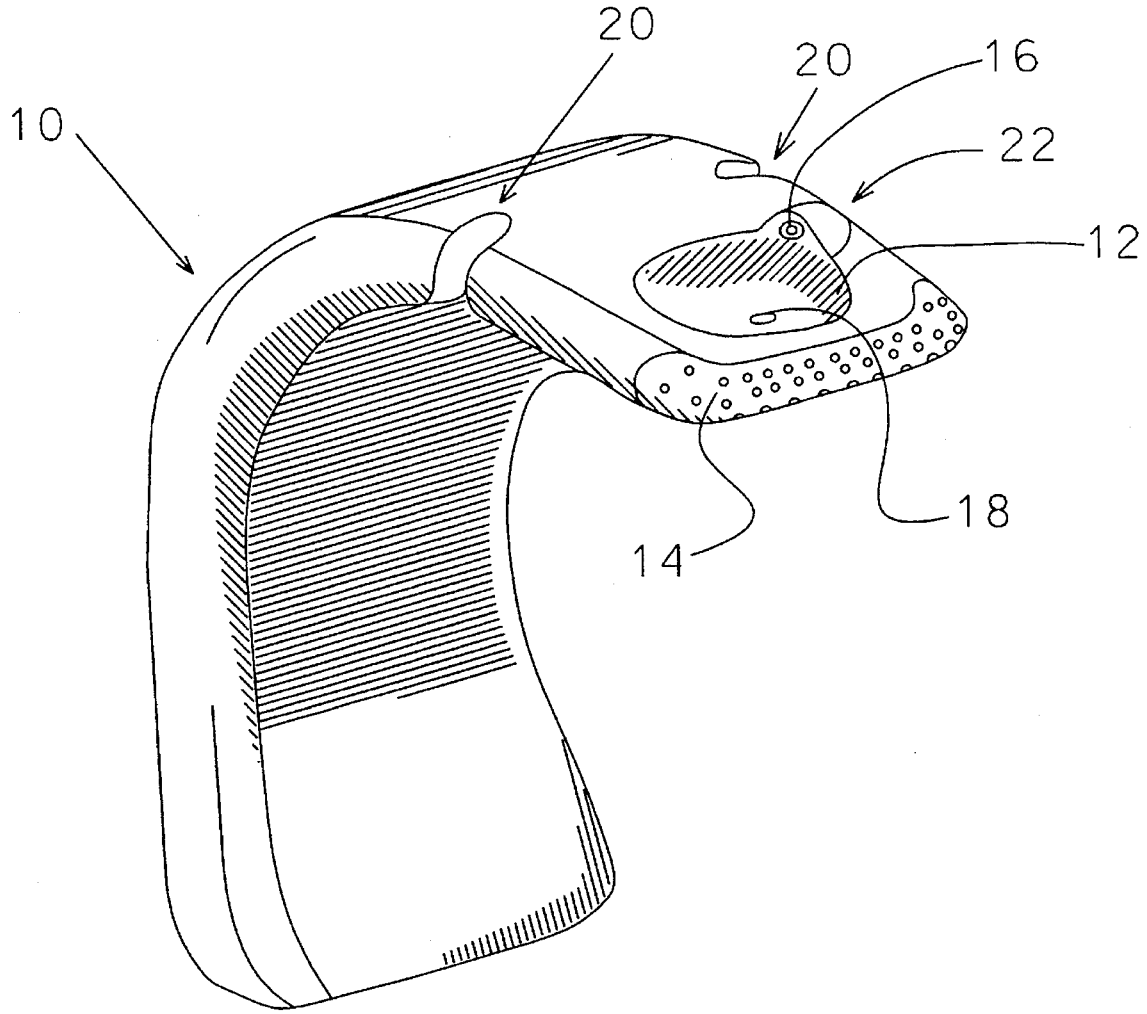
FIG. 1 shows a perspective view of the invention embodied in a free standing drinking fountain.
Figure 2:
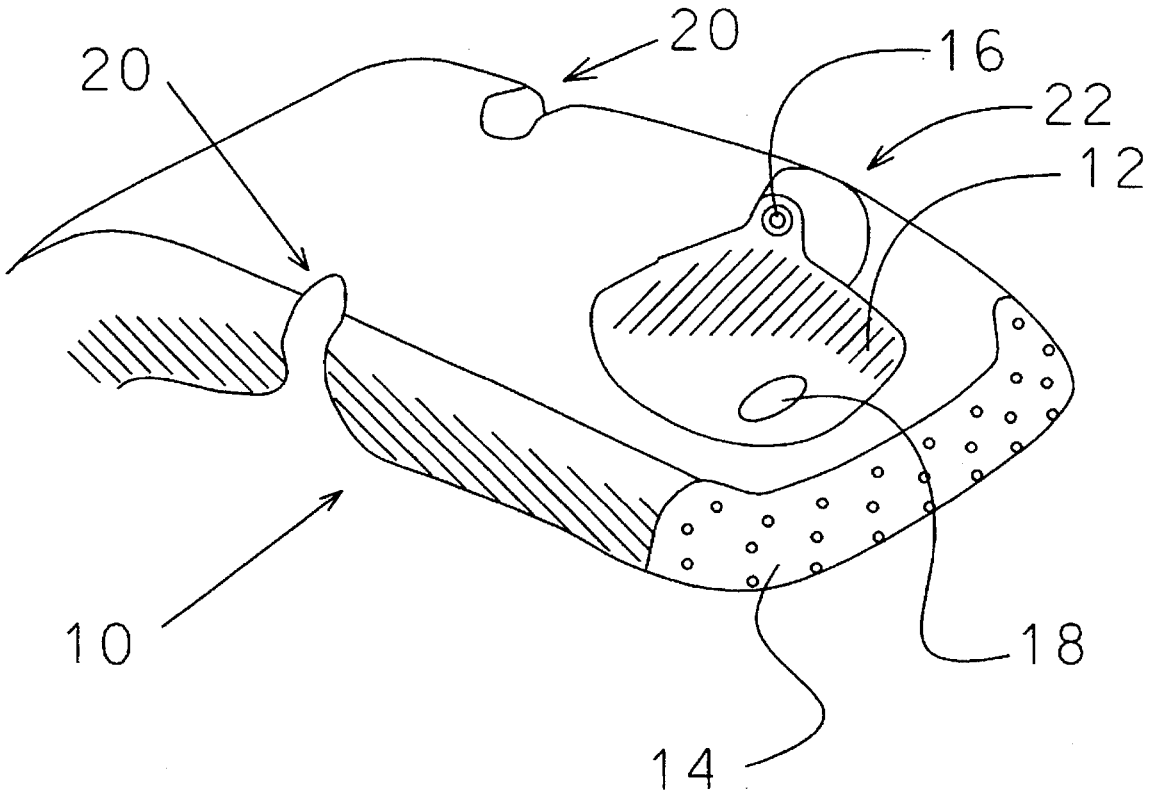
FIG. 2 shows a perspective of view the invention embodied in a wall mounted drinking fountain.
Figure 3:
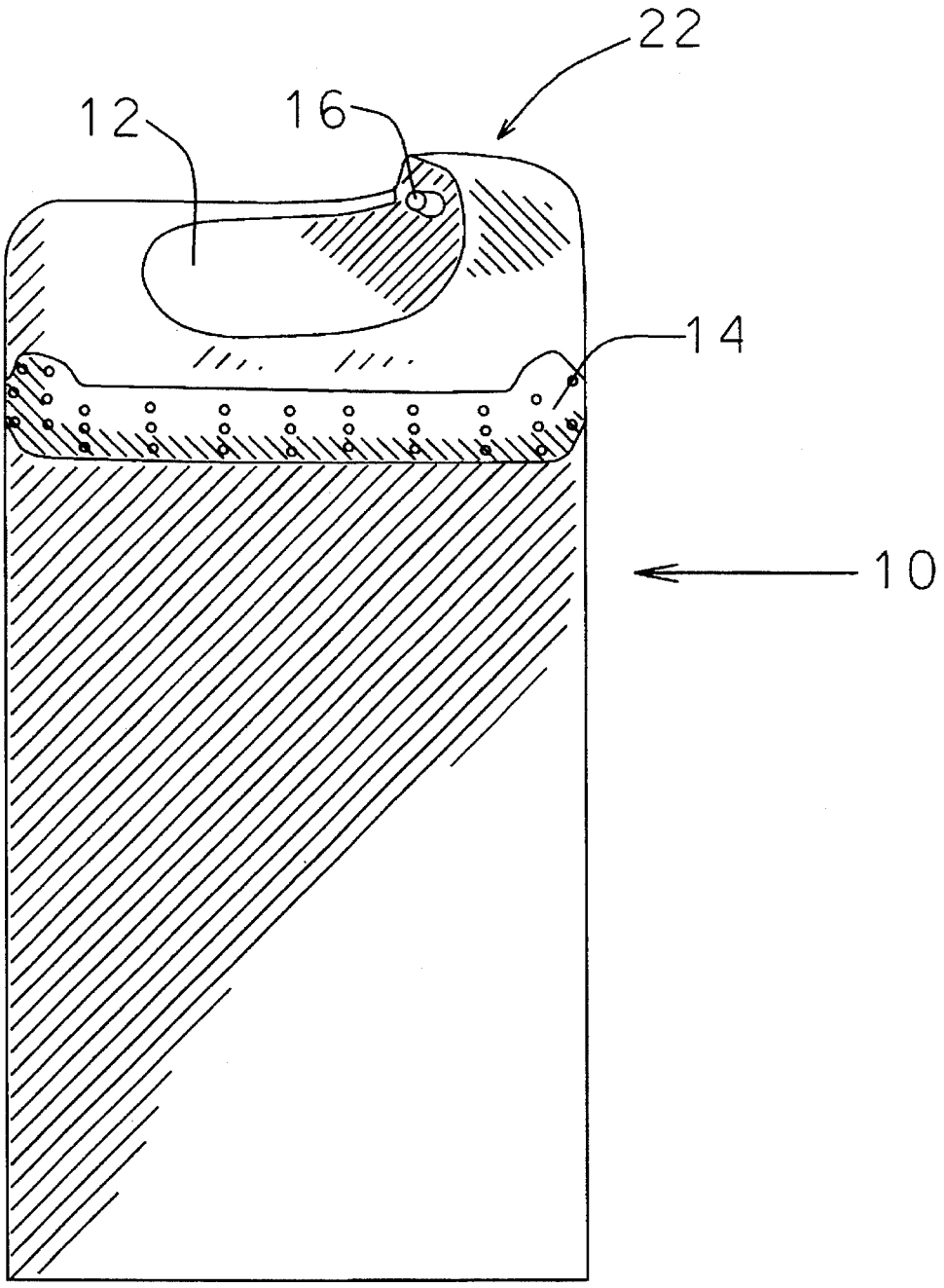
FIG. 3 shows a front view of a free standing embodiment of the invention.
Figure 4:
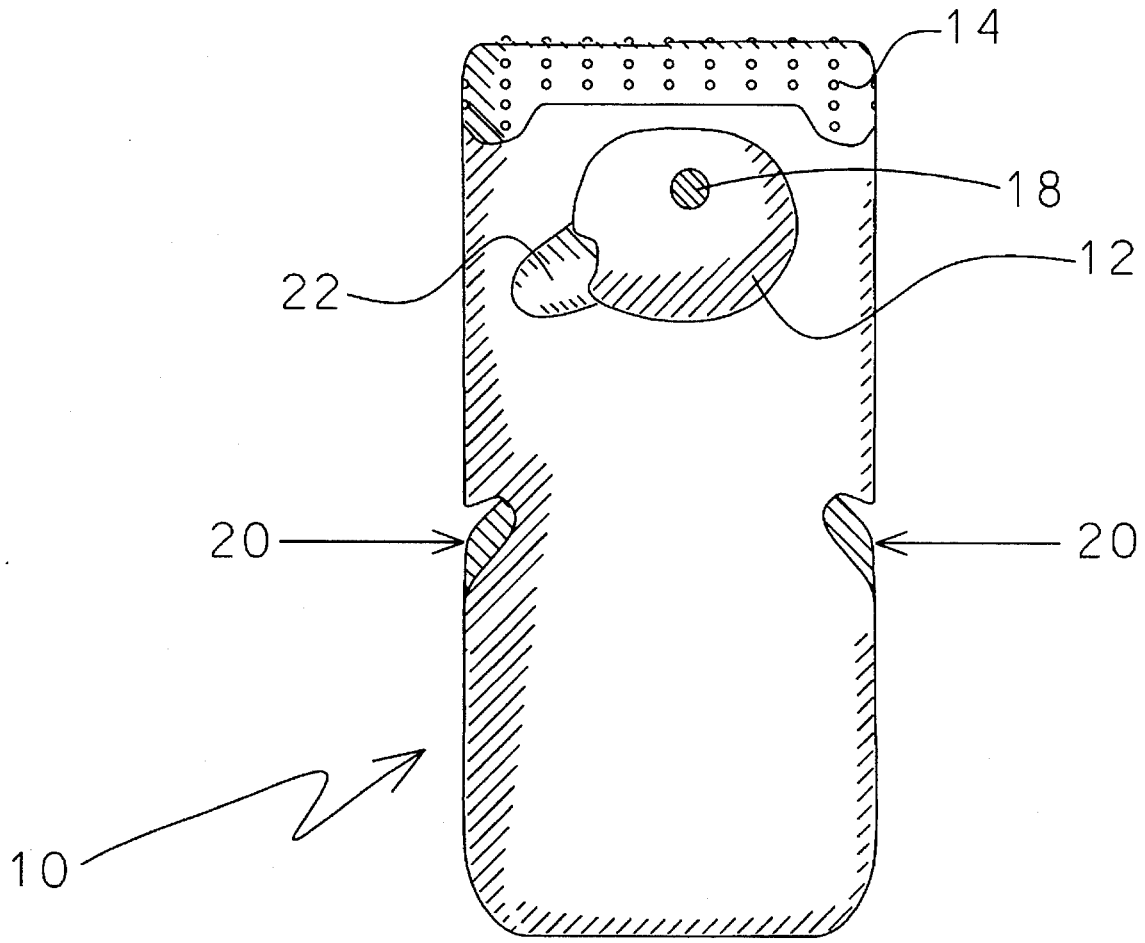
FIG. 4 shows a top view of a free standing embodiment of the invention.

The invention disclosed herein may be embodied in either a free standing or a wall mounted drinking fountain. FIG. 1 shows a perspective view of the invention embodied in a free standing fountain. The fountain body 10 supports in cantilevered fashion a basin 12 at a height of approximately thirty four inches. The basin 12 is provided with a drain 18 which communicates with a drain pipe (not shown). Adjacent to the basin is a water stream outlet 16. The outlet is positioned such that a water stream escaping the outlet will be caught within the basin. The outlet 16 is recessed within the fountain body 10. This prevents injuries which might occur if the outlet were left to protrude from the body. In the preferred embodiment, the outlet 16 is surrounded by an outlet casing 22 which is integral with the fountain body 10. The outlet casing is a smooth protrusion which indicates the location of the outlet and the direction of the water stream which it will produce. These features are illustrated from other perspectives in FIGS. 3 through 5 in a free standing embodiment, and in FIG. 2 in a wall mounted embodiment.

Figure 6:
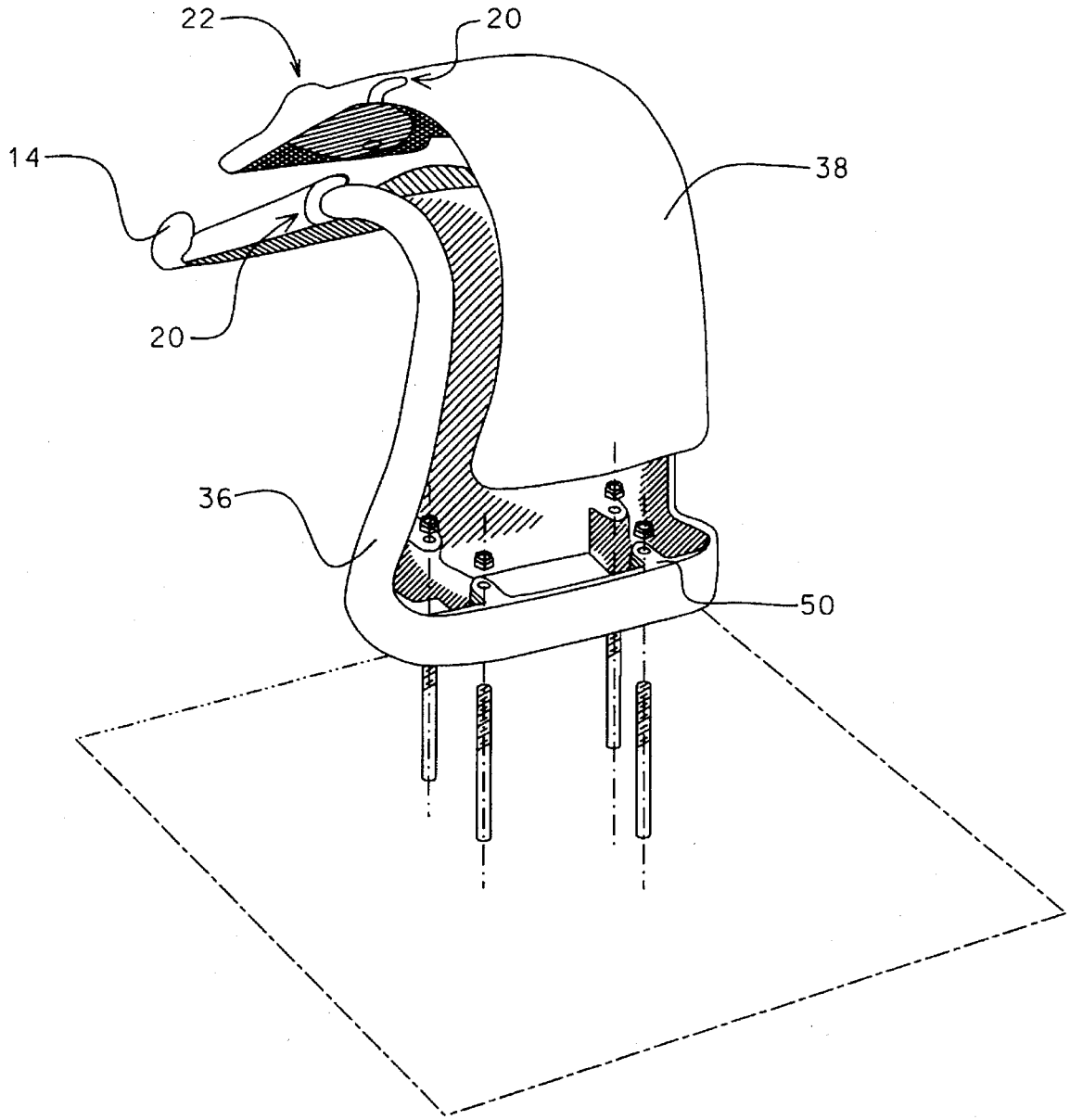
FIG. 6 shows an exploded view of the top and bottom shells of the shell of a free standing embodiment of the invention.
Figure 7:
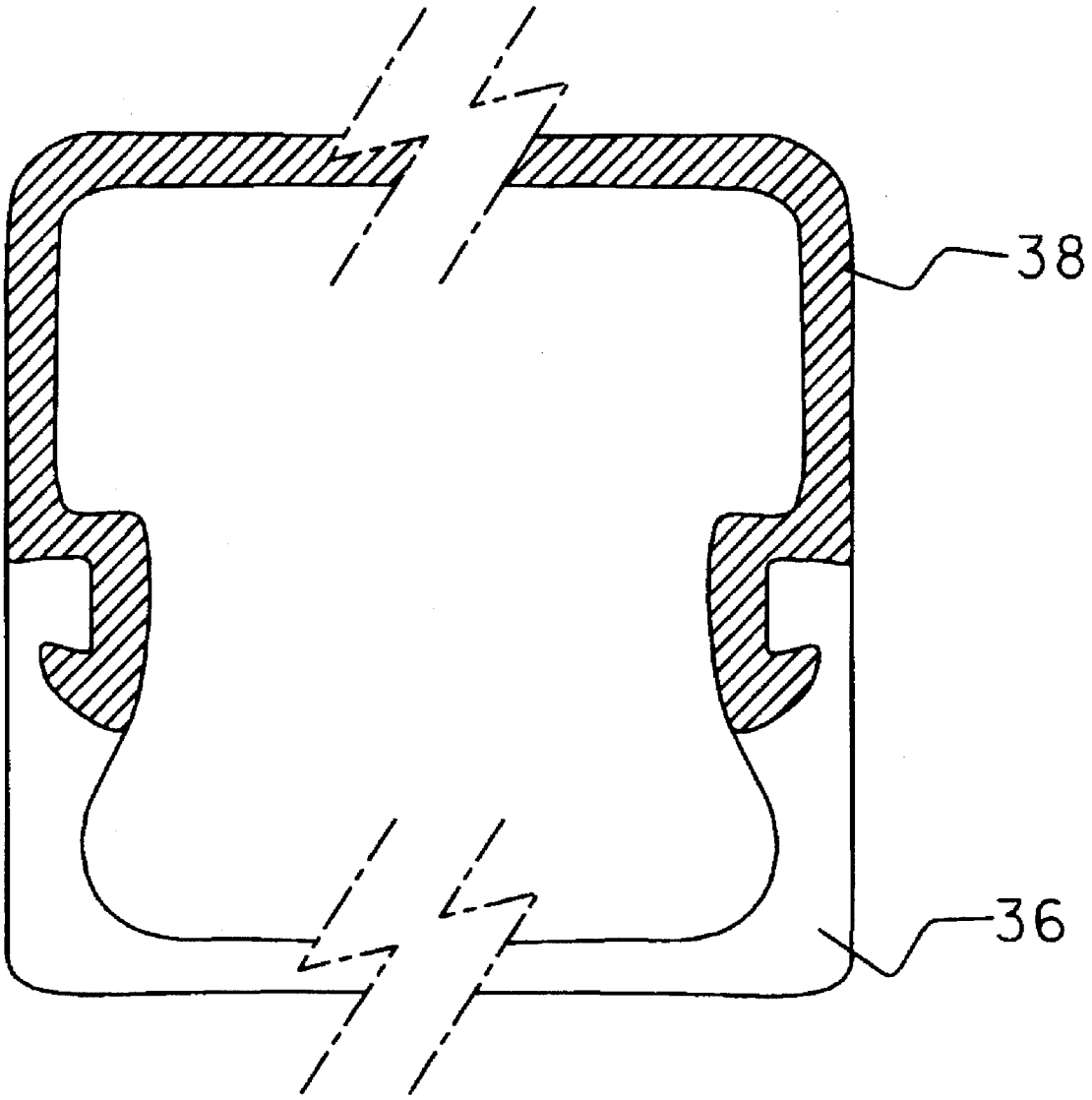
FIG. 7 shows a cross section of the joint formed between the top and bottom shells illustrated in FIG. 6.

The body of the fountain may be molded from fiberglass, or may be formed using other material and methods such as injection molding of polycarbonate plastic. The body of the fountain is formed of a bottom shell 36 and a top shell 38, as is illustrated for a free standing embodiment of the invention in FIG. 6. The top shell 38 includes the basin 12, the outlet casing 22, and the upper half of a pair of handles 20, described more fully below. The bottom shell 36 includes mounting holes 50 for receiving bolts for mounting the fountain on a surface. The mounting holes may be formed integrally with the bottom shell, or may be formed separately and attached to the bottom shell by plastic welding or any similar method. The top and bottom shells may be formed with interlocking edges to hold the two shells together as shown in the cross sectional illustration of FIG. 7. An analogous configuration may be employed for a wall mounted embodiment of the invention.

The fountain body 10 is also provided with a pair of handles 20. The handles are located behind the basin in relation to the front of the fountain. In use, a person in a wheel chair grasps these handles to pull himself inward toward the fountain. As he pulls inward, his chest will make contact with a control bar 14 which will be pressed down to initiate water flow. For aesthetic purposes and to simplify construction, the handles are preferably recessed into the body of the fountain. However, the benefits of handles can be realized by placing any type of object which can function as a gripping surface to the rear of the basin.

Figure 5:
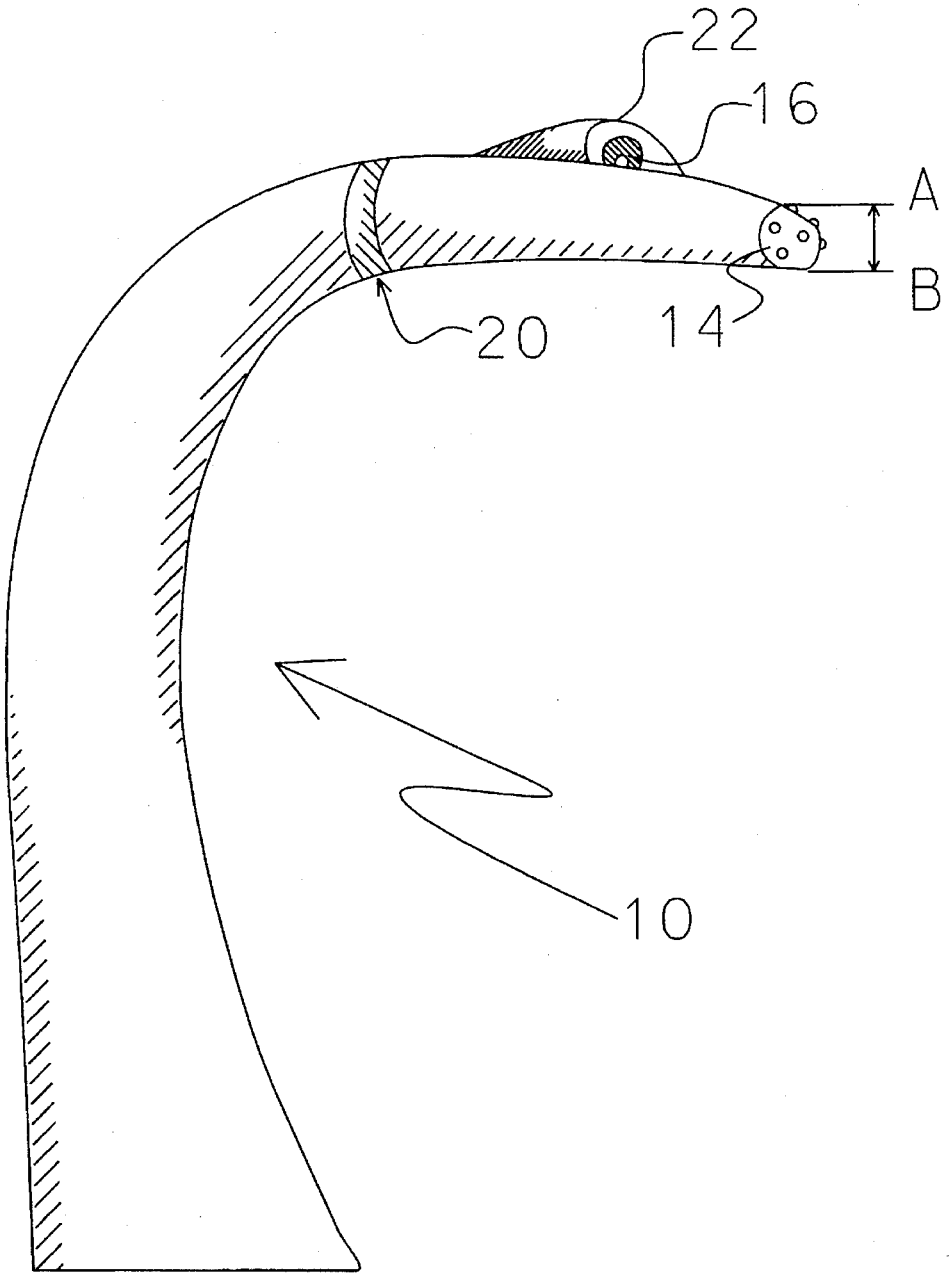
FIG. 5 shows a side view of a free standing embodiment of the invention.

A control bar 14, which is the means by which a user manipulates the flow of water, is located at the front of the fountain. The front of the fountain is that part of the fountain which is at or below the approximate height of the basin and which protrudes furthest toward the position from which a user is intended to make use of the fountain. The control bar 14 spans the height and width of the front of the fountain so that the body of the fountain 10 provides no obstruction to manipulation of the control bar 14 by a user facing the front of the fountain. FIG. 1 shows a preferred configuration in which the control bar spans the front of the fountain and additionally encompasses the front corners of the fountain. Elimination of obstructions to the control bar is most advantageously accomplished by providing a fountain body which has a slim vertical profile at its front. FIG. 5 shows a preferred vertical profile which is employed in a free standing embodiment of the invention. In this embodiment, the distance between the top surface 38 of the fountain forward of the basin 12 and the bottom surface 36 of the fountain, shown as the vertical distance between lines A and B, is approximately four inches. As such, a user approaching the front of the fountain can manipulate the control bar without obstruction from any other part of the fountain.

Figure 8:
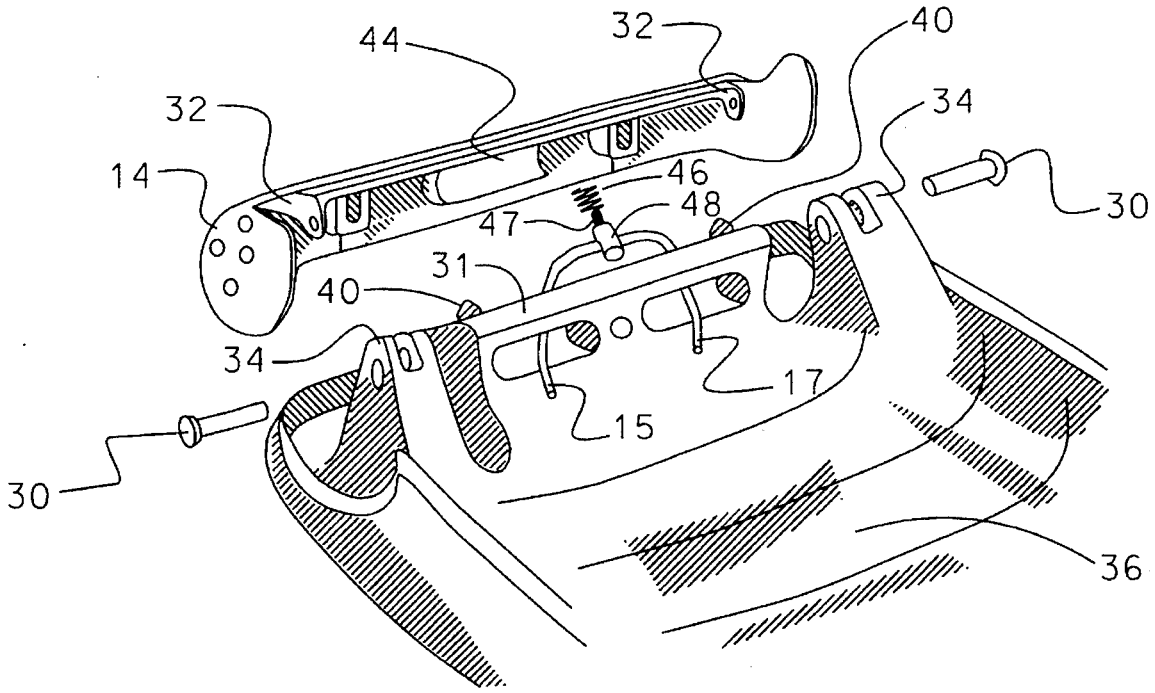
FIG. 8 shows an exploded view of a preferred embodiment of a control bar mechanism.

The control bar 14 may be embodied mechanically, as is shown in the exploded drawing of FIG. 8. In this embodiment, the control bar 14 swings on pins 30 which pass through a pair of bores 32 in the control bar 14 and a second pair of bores 34 in the control bar mounting structure 31, which is integral with the bottom shell 36 of the fountain body. Two pins 40, integral with the mounting structure 31, snap-fit into receiving holes 42 provided on the inner side of the control bar 14. Upon being engaged by the receiving holes 42, the pins limit the range of outward swinging motion of the control bar 14. Also disposed on the inner side of the control bar 14 is a bearing surface 44. A spring 46 disposed between the bearing surface 44 and the mounting structure 31 is employed to push the control bar outward from the fountain body 10 when the control bar 14 is not being pressed by a user.

In one embodiment using a mechanically embodied control bar 14, a valve mechanism 48 is mounted in the mounting structure 31 of bottom shell 36 of the fountain. The valve mechanism 48 is of the standard type having an actuating element 47 for opening a flow path between a feed line 17 and an outlet line 15 which communicates with the water stream outlet 16. The valve mechanism 48 is located such that the bearing surface 44 cooperates with the actuating element of the valve mechanism, so that upon inward movement of the control bar 14 a flow path is opened between the feed line and the water stream outlet 16.

Figure 9:
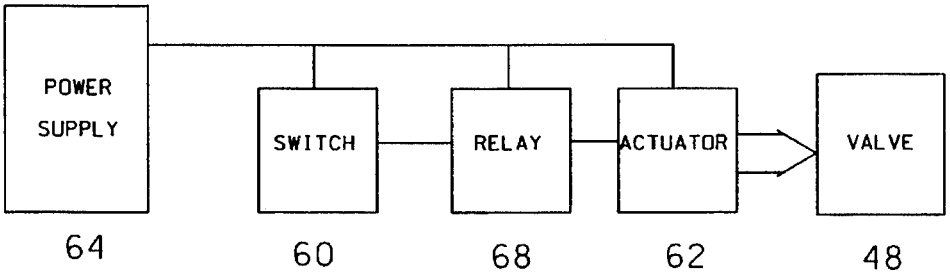
FIG. 9 shows an electrical circuit for controlling water flow in accordance with an alternative embodiment of the invention.

In an alternative embodiment using a mechanically embodied control bar, an electrical switch 60 is mounted in the mounting structure in the same location as the standard valve 48 of the embodiment described above. The switch is of the push type which is mechanically biased, such as by a spring, and which operates to complete a circuit when depressed. FIG. 9 shows the circuit employed in this embodiment, in which the switch 60 communicates electrically with an actuator 62 which is operative of a standard valve 48, as above, and which is supplied with electricity by a power supply 64. The switch and circuit are configured such that when the control bar is depressed by a user, the switch 60 is closed to complete a circuit which activates a relay 68, completing a circuit with the actuator 62, which in turn opens the valve 48 to allow water flow.

Figure 10:
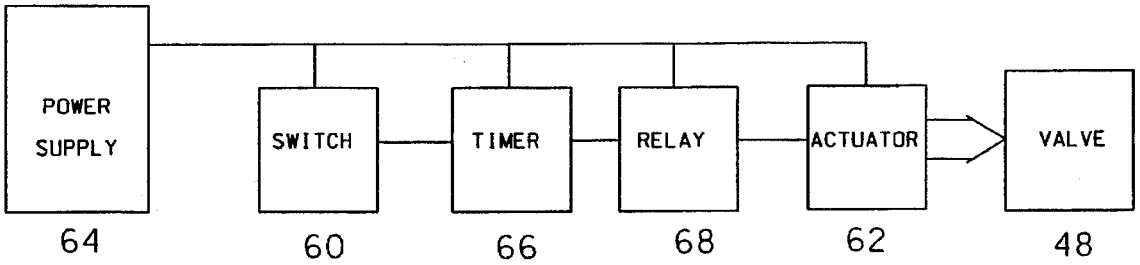
FIG. 10 shows an electrical circuit for controlling water flow in accordance with a second alternative embodiment of the invention which includes a timer circuit for maintaining water flow for a pre-determined period.

In a second alternative embodiment, the circuit is augmented, as illustrated in FIG. 10, by a timer circuit 66 which is triggered by closing the switch 60 through depression of the control bar 14. The timer circuit 66 is constructed of any well-known electronic timing mechanism, such as an integrated circuit timing chip, and is configured such that it switches on a relay 68 which in turn supplies power to the actuator 62 for the predetermined period of time during which the timer circuit 66 is operative. A timing period of five seconds, for example, would be appropriate. After the timing period has expired, the relay 68 is switched off and the timer circuit 66 is reset and ready to activate water flow upon being triggered again. In this embodiment, water will flow for a predetermined period of time subsequent to depression of the control bar. Alternatively, the circuit may be configured to provide water flow for a predetermined period of time subsequent to the release of pressure from the control bar.

In an additionally contemplated alternative embodiment of the invention, the control bar may be comprised of a touch sensitive switch which covers the same area on the front of the fountain as the mechanically embodied control bar discussed above, but eliminates the need for the mechanical parts of the mechanically embodied control bar. The touch sensitive switch is substituted for and performs the same function as the switches used in the electrical circuits described above, namely, activating a circuit which causes water to flow from the outlet. Touch sensitive rubber membrane switches appropriate for this application are supplied by the Pennwalt Corporation under the trade name PIEZO FILM.

The many possible embodiments of the several electronic circuits described above will be readily apparent to those of ordinary skill in the field of electronics.

As an aid to users of the invention, the surface of the control bar may be adapted to be differentiable from the body of the fountain. FIGS. 1 through 5 show a control bar 14 which has been formed with a textured surface, in contrast to the smooth surface of the body 10 of the fountain. The control bar may also be made of a color which is easily differentiable from the body of the fountain. For example, the body of the fountain may be colored dark blue, while the control bar is colored light blue.

Other analogous embodiments of this invention are also contemplated as being within the scope of this disclosure, such as a drinking fountain using an electromechanical pump operated by the control bar as disclosed above.

What is claimed is:

1. A drinking fountain, comprising:

a basin;

a control bar operative of a valve which controls water flow;

said control bar being located forward of said basin at the uppermost frontal edge of said fountain;

said control bar further being adapted to span the forwardmost portion of said uppermost frontal edge of said fountain.

2. The apparatus of claim 1, wherein:

said control bar is adapted to be sensuously differentiable from the remainder of said fountain.

3. The apparatus of claim 1, further comprising:

a pair of opposing handles, located rearward of said basin;

said handles being adapted for use by a user of said fountain to allow said user to pull himself toward said control bar of said fountain.

4. The apparatus of claim 3, wherein:

said control bar is adapted to be sensuously differentiable from the remainder of said fountain.

5. The apparatus of claim 2 or 4, wherein said control bar is adapted to be sensuously differentiable from the remainder of said fountain in that its surface is of a different texture than the surface of the remainder of said fountain.

6. The apparatus of claim 2 or 4, wherein said control bar is adapted to be sensuously differentiable from the remainder of said fountain in that its surface is of a different color than the remainder of said fountain.

7. The apparatus of claim 1, wherein:

said control bar is mechanically coupled to said valve;

whereby pressing said control bar opens said valve to allow water flow from a water feed line to a water stream outlet.

8. The apparatus of claim 1, further comprising:

an electronic circuit operative of said valve; and a switch, operative of said valve by means of said circuit, and adapted to be operated by said control bar;

whereby pressing said control bar is operative of said electronic circuit to open said valve to allow water flow from a water feed line to a water stream outlet.

9. The apparatus of claim 8, wherein said control bar comprises a touch sensitive switch, said touch sensitive switch also operating as said switch operative of said electronic circuit for controlling said valve.

10. A free standing drinking fountain comprising:

a basin;

a control bar operative of a valve which controls water flow;

said control bar being located forward of said basin at the uppermost frontal edge of said fountain;

said control bar further being adapted to span the forwardmost portion of said uppermost frontal edge of said fountain;

said control bar further being adapted to be sensuously differentiable from the remainder of said fountain; and a pair of opposing handles, located rearward of said basin;

said handles being adapted for use by a user of said fountain to allow said user to pull himself toward said control bar of said fountain.

11. A wall mounted drinking fountain, comprising:

a basin;

a control bar operative of a valve which controls water flow;

said control bar being located forward of said basin at the uppermost frontal edge of said fountain;

said control bar further being adapted to span the forwardmost portion of said uppermost frontal edge of said fountain;

said control bar further being adapted to be sensuously differentiable from the remainder of said fountain; and, a pair of opposing handles, located rearward of said basin;

said handles being adapted for use by a user of said fountain to allow said user to pull himself toward said control bar of said fountain.

* * * * *